United States Patent [19]

Gorman

[11] Patent Number: 5,048,834

[45] Date of Patent: Sep. 17, 1991

[54] IRON TYPE GOLF CLUB HEAD

[75] Inventor: Geoffrey W. Gorman, Greer, S.C.

[73] Assignee: Dunlop Slazenger Corp., Greenville, S.C.

[21] Appl. No.: 529,943

[22] Filed: May 29, 1990

[51] Int. Cl.[5] ..... A63B 53/04

[52] U.S. Cl. ..... 273/167 F; 273/167 H; 273/169

[58] Field of Search ..... 273/167 F, 167 H, 169, 273/171, 172

[56] References Cited

U.S. PATENT DOCUMENTS

| | | | |
|---|---|---|---|
| D. 229,434 | 11/1973 | Lrower | D34/5 GN |
| D. 267,965 | 2/1983 | Kobayashi | D21/220 |
| 2,087,685 | 7/1937 | Hackney | 273/77 |
| 2,846,228 | 8/1958 | Reach | 273/169 |
| 3,814,437 | 6/1974 | Winquist | 273/167 R |
| 4,128,244 | 12/1978 | Duclos | 273/164 |
| 4,136,877 | 1/1979 | Antonious | 273/164 |
| 4,325,553 | 4/1982 | Taylor | 273/167 F |
| 4,326,326 | 4/1982 | MacDonald | 273/169 X |
| 4,355,808 | 10/1982 | Jernigan | 273/169 |
| 4,508,350 | 4/1985 | Duclos | 273/183 |
| 4,511,145 | 4/1985 | Schmidt | 273/167 H |
| 4,569,523 | 2/1986 | Jarvis | 273/164 |
| 4,621,813 | 11/1986 | Solheim | 273/77 A |
| 4,826,172 | 5/1989 | Antonious | 273/169 |
| 4,907,806 | 3/1990 | Antonious | 273/169 X |
| 4,921,252 | 5/1990 | Antonious | 273/164 |

*Primary Examiner*—William H. Grieb

*Attorney, Agent, or Firm*—Lorusso & Loud

[57] ABSTRACT

An iron type golf club head including heel, toe, bottom sole, top ridge and hosel portions, a face surface having a center of percussion, a rear surface, a peripheral mass formed on the rear surface and forming a cavity, and a weight portion extending from the rear surface and disposed behind the center of percussion.

4 Claims, 4 Drawing Sheets

IRON TYPE GOLF CLUB HEAD

CROSS-REFERENCE TO RELATED APPLICATION

This application is closely related by subject matter to U.S. application Ser. No. 07/529,957, filed May 29, 1990.

BACKGROUND OF THE INVENTION

1. Field of the Invention

This invention relates to instruments for impacting an object, and is directed more particularly to an iron type golf club head weighted for improved performance.

2. Description of the Prior Art

Attempts at improving the performance of golf clubs has produced a myriad of concepts, directed for the most part to improved distance through which a hit ball will travel and improved accuracy in both putting and driving.

One aspect of improvement has been in the area of weight distribution in iron type heads and on approach that has been used is peripheral or perimeter weighting, that is, locating weight around the periphery or perimeter of the club head. Peripheral weighting provides a cavity, or recess, centrally located in the back of the club head. An example of peripheral weighting may be found in U.S. Pat. No. 4,621,813, issued Nov. 11, 1986 to Karsten Solheim.

Others, rather than dispersing weight around the periphery of a club head, have elected to concentrate weight midway of the club head, or at a point approximately behind the center of percussion. An example of such an arrangement may be seen in U.S. Pat. No. 2,087,685, issued July 20, 1937 to Clarence W. Hackney. The Hackney club head is essentially a flat blade with a bulbous weight member on the rear of the blade.

Still others have combined the perceived advantages of peripheral weighting with the perceived additional advantages of distributing weight within the cavity formed by peripheral weighting. Examples of such club heads may be seen in U.S. Pat. No. 3,814,437, issued June 14, 1974 in the name of S. William Winquist: U.S. Pat. No. 4,355,808. issued Oct. 26, 1982, in the name of Doyle D. Jernigon; and U.S. Pat. No. 4,826,172, issued May 2, 1989 in the name of Anthony J. Antonious. The Winquist patent shows a club head provided with perimeter weighting and, in addition, integral ribbing extending within the cavity at the rear of the club head, the ribbing being in the form of letters or symbols. Jernigon disposes a number of small weights along the bottom edge of the cavity and fills the cavity with epoxy. The object of Jernigon's invention is to tailor a club to an individual golfer's swing. The Antonious patent shows the use of perimeter weighting and weight members within the cavity, but removed from the center of percussion. The Antonious arrangement is said to assist the player most particularly with respect to miss-hit balls, that is, balls struck off the center of percussion of the club head.

SUMMARY OF THE INVENTION

An object of the present invention is to provide an instrument, such as a golf club head, with a combination of perimeter weighting and additional weighting, the additional weighting being disposed within the perimeter and immediately behind the center of percussion.

With the above and other objects, in view, as will hereinafter appear, a feature of the present invention is the provision of an instrument for impacting an object, the instrument including a head portion having a substantially flat face surface for engagement with the object, the object being smaller at its point of impact than the face surface, the face surface having a center of percussion at which the face surface is adapted to engage the object upon impact, the head portion further having a rear surface, a peripheral mass formed on the rear surface and extending therefrom to form a cavity, a bottom of the cavity being defined by the rear surface, and a weight portion extending from the rear surface and being disposed behind the center or percussion.

In accordance with a further feature of the invention, there is provided an iron type golf club head comprising heel, toe, bottom sole, top ridge and hosel portions. a face surface having a center of percussion, a rear surface, a peripheral mass formed on the rear surface adjacent the heel, toe, bottom sole and top ridge portions, the peripheral mass defining a cavity, a bottom of the cavity being defined by the rear surface, and a weight portion extending from the rear surface and being disposed behind the center of percussion.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
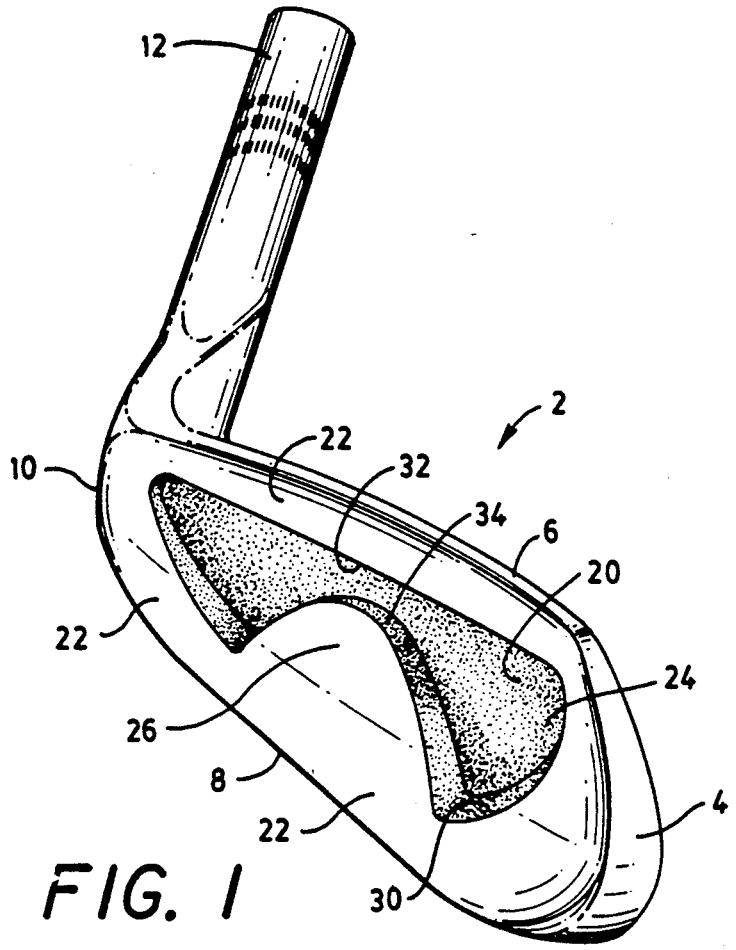
FIGS. 1 and 2 are perspective views of one form of golf club head illustrative of an embodiment of the invention.
Figure 2:
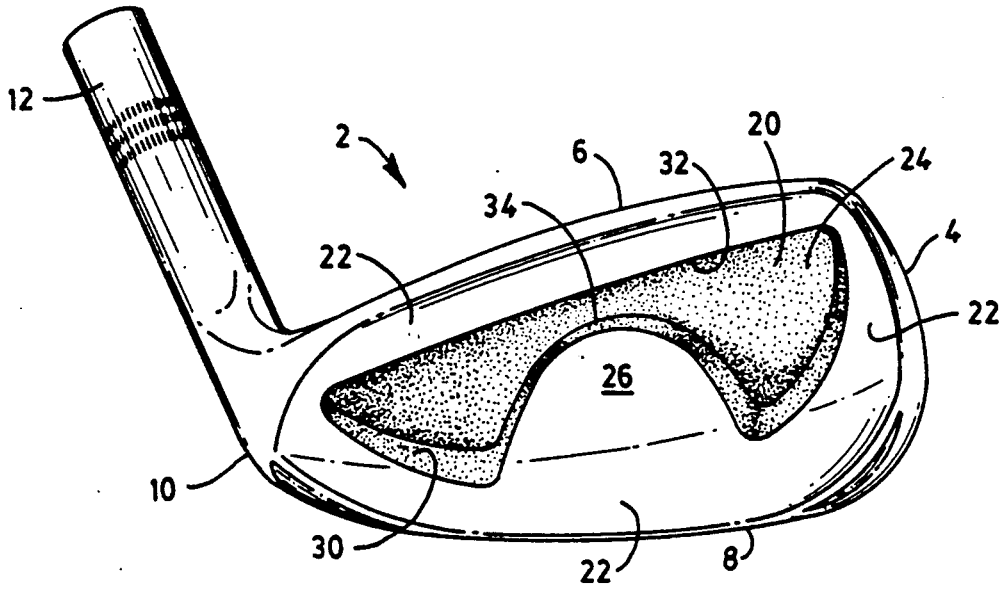
Figure 3:
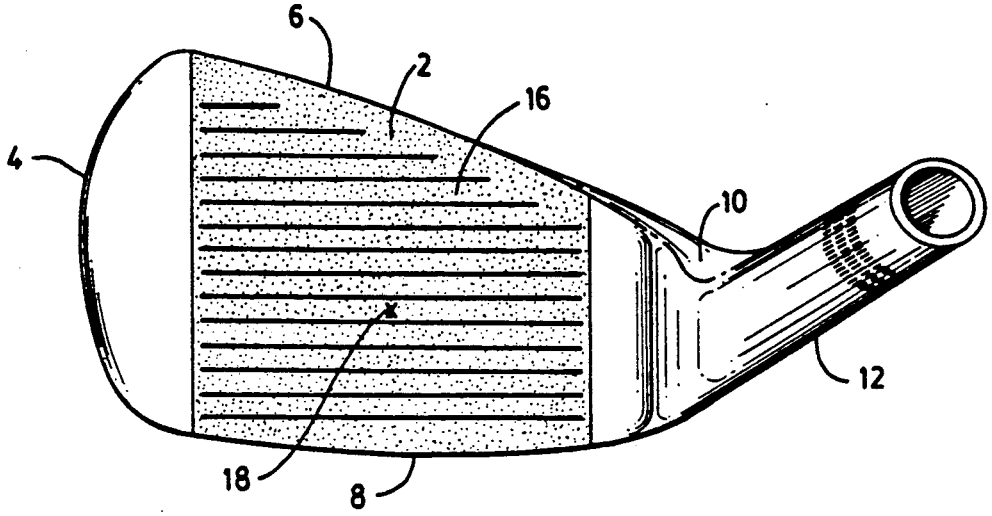
FIG. 3 is a front elevational view thereof.
Figure 4:
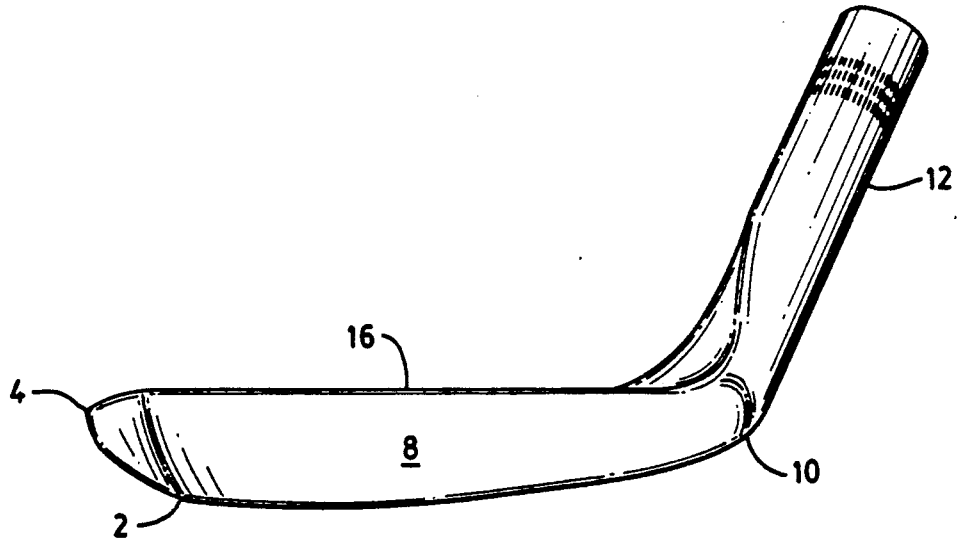
FIG. 4 is a bottom view thereof.

Referring to the drawings, particularly FIGS. 1 and 2, it will be seen that the illustrative golf club head includes a blade member 2 having a toe portion 4, a top ridge portion 6, a bottom sole portion 8 and a heel portion 10. Extending from the heel portion region of the club head is a hosel portion 12 adapted to receive and be retained on a shaft member (not shown). The club head is provided with a substantially flat face surface 16 (FIGS. 3 and 4) having therein a center of percussion 18, which is the spot ideally adapted to engage a golf ball at impact, and a rear surface 20.

Figure 7:
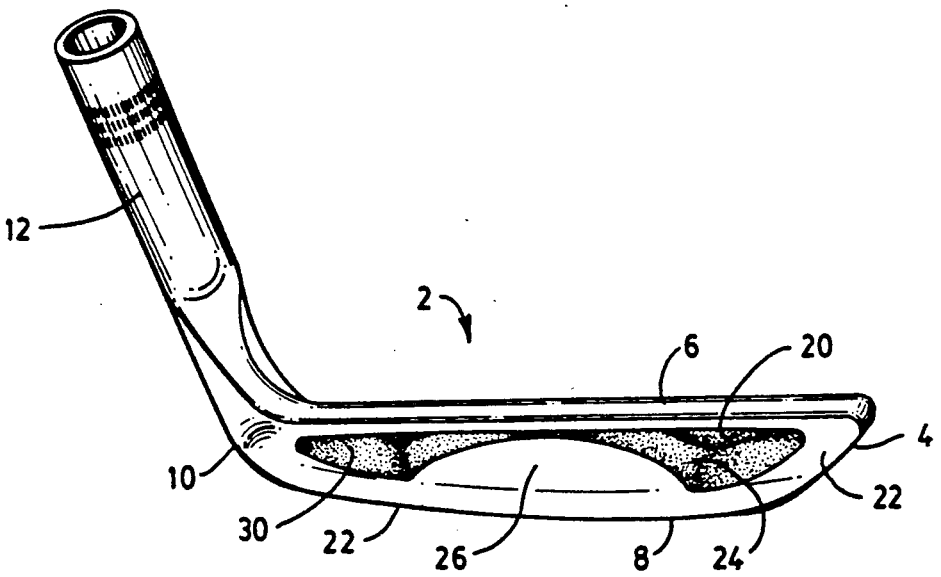
FIG. 7 is a top view thereof.

A peripheral mass 22 (FIGS. 1, 2 and 7) is formed on the rear surface 20 (FIGS. 1 and 2) adjacent the heel, toe, top ridge and bottom sole portions and defines a cavity 24. The rear surface 20 defines the bottom of the cavity 24.

A weight portion 26 extends from the rear surface 20 and is disposed on the rear surface 20 behind the center of percussion 18. Preferably, the weight portion 26 extends from the peripheral mass 22 adjacent the bottom sole portion 8 of the club head and is spaced from the peripheral mass adjacent the top ridge, heel and toe portions.

Figure 5:
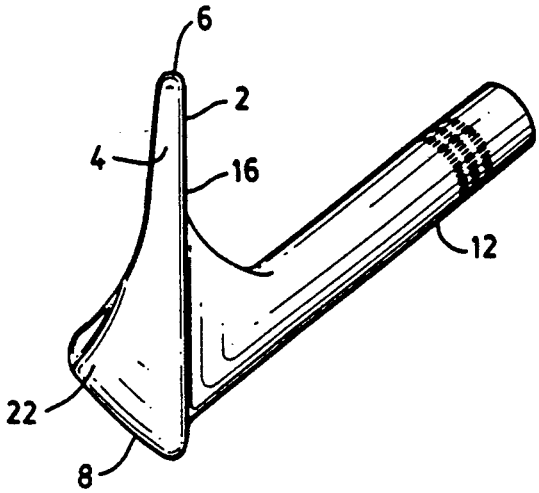
FIG. 5 is a toe end view thereof.
Figure 6:
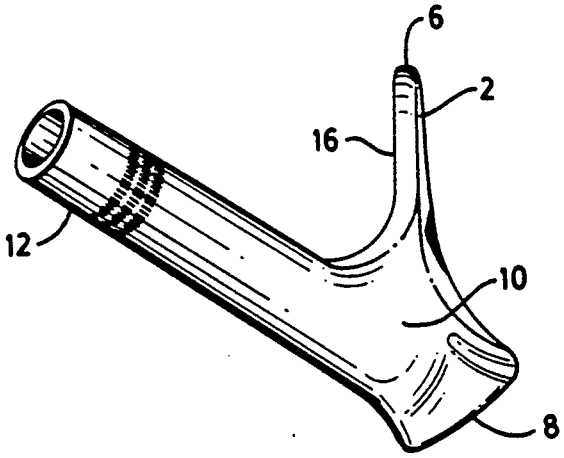
FIG. 6 is a heel end view thereof.

Referring to FIGS. 1, 2 and 5, it will be apparent that the thickness, and therefore the weight, of the peripheral mass 22 adjacent the bottom sole portion 8 substantially exceeds the thickness and weight of the peripheral mass adjacent the top ridge portion 6. Accordingly, a first wall 30 of the cavity 24 formed by the peripheral mass 22 adjacent the bottom sole portion 8 upstands from the rear surface 20 to an extent substantially greater than a second wall 32 of the cavity 24 formed by the peripheral mass adjacent the top ridge portion 6.

In like manner, the weight portion 26 has a thickness at its juncture with the peripheral mass 22 adjacent the bottom sole portion 8 substantially exceeding its thickness at its edge 34 closest the top ridge portion 6. However, in all instances the extent of the weight portion 26 from the bottom 20 of the cavity 24 is less than the maximum extent of the peripheral mass 22, that is, less than the extent of the peripheral mass adjacent the bottom sole portion 8.

The club head blade member 2 is formed of metal and the peripheral mass 22 is a solid metal mass of the same metal as the club head blade member 2. The weight portion 26 is a solid metal extension of the peripheral mass, the weight portion 26 extending from the peripheral mass 22 at a single location adjacent the bottom sole portion 8, from which the weight portion 26 extends inwardly of the cavity 24 and occupies the aforesaid location behind the center of percussion 18. As seen in FIGS. 1 and 2, the majority of the periphery of the weight portion 26 is bounded by the cavity 24. Thus, aside from the aforesaid single location, the weight portion 26 is spaced from the peripheral mass 22.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. An iron type golf club head comprising a heel portion, a toe portion, a bottom sole portion, a top ridge portion, a hosel portion, a face surface having a center of percussion, a rear surface, a peripheral mass formed on said rear surface adjacent said heel, toe, bottom sole and top ridge portions, said peripheral mass defining a cavity, a bottom of said cavity being defined by said rear surface, and a weight portion extending from said rear surface and being disposed behind said center of percussion, said weight portion extending from said peripheral mass adjacent said bottom sole portion and being spaced from said peripheral mass adjacent said top ridge portion and said heel and toe portions, said weight portion having a thickness at its juncture with said peripheral mass adjacent said bottom sole portion substantially exceeding the thickness of said weight portion at its edge closest said top ridge portion.

2. The invention in accordance with claim 1 in which a first wall of said cavity formed by said peripheral mass adjacent said bottom sole portion upstands from said rear surface to an extent substantially greater than a second wall of said cavity formed by said peripheral mass adjacent said top ridge portion.

3. An iron type golf club head comprising a heel portion, a toe portion, a bottom sole portion, a top ridge portion, a hosel portion, a face surface having a center of percussion, a rear surface, a peripheral mass formed on said rear surface adjacent said heel, toe, bottom sole and top ridge portions, said head being formed of metal, said peripheral mass comprising a solid metal mass and defining a cavity, a bottom of said cavity being defined by said rear surface, and a weight portion extending from said rear surface, said weight portion comprising a solid metal portion bounded on the majority of its periphery by said cavity and extending from said peripheral mass adjacent said bottom sole portion and spaced from said peripheral mass adjacent said top ridge portion and said heel and toe portions, said weight portion extending inwardly of said cavity and occupying said disposition behind said center of percussion, said weight portion having a thickness at its juncture with said peripheral mass adjacent said bottom sole portion substantially exceeding its thickness at its edge closest said top ridge portion.

4. The invention in accordance with claim 3 in which the extent of said weight portion from said bottom of said cavity is less than the maximum extent of said peripheral mass.

* * * * *